US005531206A

United States Patent [19]

Kitson et al.

[11] Patent Number: 5,531,206

[45] Date of Patent: Jul. 2, 1996

[54] CAPACITATIVE DISCHARGE IGNITION SYSTEM FOR INTERNAL COMBUSTION ENGINES

[76] Inventors: Mark R. Kitson, 2 Barnet Place, Kingsley, Western Australia 6026; Peter J. Ayre, 40 Riga Crescent, Willeton, Western Australia 6155, both of Australia

[21] Appl. No.: 412,205

[22] Filed: Mar. 27, 1995

Related U.S. Application Data

[63] Continuation of Ser. No. 282,025, Jul. 29, 1994, abandoned, which is a continuation of Ser. No. 39,303, filed as PCT/AU91/00524, Nov. 15, 1990, published as WO92/08891, May 29, 1992, abandoned.

[30] Foreign Application Priority Data

Nov. 15, 1990 [AU] Australia ..... PK3373

[51] Int. Cl.[6] ..... F02P 3/06

[52] U.S. Cl. ..... 123/596

[58] Field of Search ..... 123/596, 599, 123/594, 636, 620; 315/209 CO, 209 T, 209 SC

[56] References Cited

U.S. PATENT DOCUMENTS

| | | | |
|---|---|---|---|
| 3,234,430 | 2/1966 | Issler et al. | 315/209 |
| 3,782,353 | 1/1974 | Kammerer et al. | 123/148 |
| 4,154,205 | 5/1979 | Förster | 123/596 |
| 4,558,683 | 12/1985 | Okuda | 123/599 |
| 4,886,036 | 12/1989 | Johansson et al. | 123/596 |
| 4,967,037 | 10/1990 | Roberts . | |
| 5,049,786 | 9/1991 | Gotisar et al. | 315/209 CD |
| 5,207,208 | 5/1993 | Ward | 123/596 |

FOREIGN PATENT DOCUMENTS

| | | |
|---|---|---|
| 0270162 | 12/1986 | European Pat. Off. . |
| 2534635 | 10/1982 | France . |
| 217580A1 | 1/1985 | German Dem. Rep. . |
| 3131844A1 | 4/1983 | Germany . |
| 3822794A1 | 1/1990 | Germany . |
| 1268290 | 3/1972 | United Kingdom . |

*Primary Examiner*—Raymond A. Nelli

*Attorney, Agent, or Firm*—Nikaido Marmelstein Murray & Oram

[57] ABSTRACT

A method and apparatus for a flyback control circuit wherein primary coil current is minimized during flyback operation such that the spark duration and energy delivered to the spark gap are maximized.

19 Claims, 3 Drawing Sheets

CAPACITATIVE DISCHARGE IGNITION SYSTEM FOR INTERNAL COMBUSTION ENGINES

This application is a continuation of application Ser. No. 08/282,025, filed on Jul. 29, 1994, now abandoned, which is a continuation application of Ser. No. 08/039,303, filed as PCT/AU91/00524, Nov. 15, 1990, published as WO92/08891, May 29, 1992, now abandoned.

FIELD OF THE INVENTION

The present invention relates to a method of producing spark in a capacitative discharge ignition system for internal combustion engines and also to an improved capacitative discharge ignition system therefor. In particular, the present invention relates to a capacitative discharge ignition system for internal combustion engines having a low-capacitance high-voltage charge storage means or capacitor.

BACKGROUND OF THE INVENTION

In the motor industry, there has been a trend to use electronic ignition systems to improve the efficiency and performance of internal combustion engines by producing a spark with desired characteristics to initiate combustion of the air-fuel mixture.

Nevertheless, in the case of capacitative discharge systems, where sufficient spark voltage can build up in a relatively short period, it has been found that the spark produced by the spark voltage is of relatively short duration. Such operation characteristics are even more particularly so in a capacitative discharge ignition system having a low-capacitance high-voltage charge storage means or capacitor.

The high-voltage will cause a high discharging current passing through the primary coil to induce the necessary spark voltage in the secondary coil to produce the spark. However, the low-capacitance limits the duration of that current and thus, the duration of the spark as produced.

It has been realised that the spark duration may sometimes be too brief to properly ignite the air-fuel mixture, particularly for a lean mixture.

A proposal to merely increase the capacitance of the charge storage means or capacitor would not significantly extend the spark duration, but rather would cause a more intense spark. Another proposal to provide a resistor in the primary circuit to reduce the rate of discharge would also reduce the amount of the discharging current and the energy available for the spark.

Further, the use of transistors of the type called silicon controlled rectifiers to initiate the discharge of energy from the charge storage means or capacitor would invariably allow the energy which has been stored in the primary coil during the discharge to dissipate within the primary circuit.

SUMMARY OF THE INVENTION

The present invention has as its object to alleviate some of the disadvantages above discussed.

It is an object of the present invention to provide a method of producing an improved spark in a capacitative discharge ignition system for internal combustion engines.

It is an object of the present invention to provide an improved capacitative discharge ignition system for internal combustion engines.

In accordance with one aspect of the present invention, there is provided a method of producing spark in a capacitative discharge ignition system for internal combustion engines, the capacitative discharge ignition system comprising a charge storage means coupled to the primary coil of an ignition coil means having the secondary coil thereof coupled to a spark means. The method comprises the steps of discharging the charge storage means to provide a primary current through the primary coil for enabling the spark means to generate a spark, and terminating the primary current in the primary circuit to induce a flyback potential across the primary coil to regenerate the spark for increasing the total spark duration.

The sudden termination of the primary current abruptly breaks the primary circuit. As a result, a flyback potential having reverse polarity to the discharge potential is induced across the primary coil. The energy which has been stored in the primary coil during the discharge would be dissipated through the secondary circuit by regenerating the spark, thus effectively increasing the total spark duration.

Preferably, in order to maximise the effect, the primary current may be terminated at about the time when the charge storage means is substantially fully discharged. In this way, the spark generated by the discharge potential would not be prematurely terminated and a minimum amount of the flyback energy would be lost within the primary circuit. Thus, the maximum amount of the discharge energy would be efficiently used to generate and regenerate the spark.

In practice, the primary current may also be terminated a short time before or after the charge storage means is substantially fully discharged. Conveniently, the discharge of the charge storage means may be terminated after a preselected period, which would preferably be selected to correspond to the time required to substantially fully discharge the charge storage means.

In one embodiment, the method may also comprise the step of monitoring the capacitative discharge ignition system during the discharge of the charge storage means, to determine when the charge storage means is substantially fully discharged.

In a further embodiment, the method may further comprise the step of modifying the rate of discharge of the charge storage means during the discharge of the charge storage means, to initially obtain a first rate of discharge for establishing the spark and then to obtain a reduced rate of discharge for sustaining the spark. This further step has the effect of varying the duration of the discharge and as a result, the time taken, after the initiation of the discharge, for generating the spark as well as the duration of the spark can be varied.

In particular, the method of the present invention may advantageously extend the duration of discharging the charge storage means so to extend the duration of the spark as produced. In this regard, two charge storage means may be provided to discharge through the primary coil. Conveniently, the two charge storage means are arranged in parallel. Preferably, where a first and a second charge storage means are provided, the first has a higher voltage than the second, and the higher voltage charge storage means is connected to the primary coil first for discharge and as the output voltage thereof falls, the second charge storage means is also connected to the primary coil for discharge so both charge storage means discharge together through the primary coil.

Since extra charges are provided to the primary coil, the duration of the discharging current passing through the primary coil can be extended without significantly adversely effecting the amount of the primary coil current. Further, it would be appreciated that where two charge storage means are provided, both the durations of discharge of each of the two charge storage means can be varied to obtain the desired operation characteristics.

Preferably, the first charge storage means is a low-capacitance high-voltage capacitor and the second charge storage means is a high-capacitance low-voltage capacitor. In this regard, a charge storage isolation means is povided in the circuit between the two charge storage means and the discharge of the low-voltage charge storage means would occur when the potential of the high-voltage discharging charge storage means reaches or is not greater than, that of the low-voltage charge storage means.

In another embodiment, the second charge storage means may include a number of capacitors having different capacitance and potential ratings with respective charge storage isolation means in the form of diodes disposed therebetween. The respective capacitors would then discharge when the respective potentials are or have been reached.

Alternatively, the discharge of the second charge storage means may occur after a predetermined period from the initiation of the discharge of the first charge storage means, which for example may coincide with the time taken for establishing the spark, and the discharge of the second charge storage means would then be used to sustain the spark as produced.

In accordance with another aspect of the present invention, there is provided a capacitative discharge ignition system for internal combustion engines, comprising a charge storage means coupled to the primary coil of an ignition coil means having the secondary coil thereof coupled to a spark means, and a switching means arranged to discharge the charge storage means to provide a primary current through the primary coil for enabling the spark means to generate a spark. The switching means is arranged to terminate the primary current in the primary circuit to induce a flyback potential across the primary coil to regenerate the spark for increasing the total spark duration. In practice, a flyback control means may be coupled to the primary coil.

The switching means may be arranged to terminate the primary current at about the time when the charge storage means is substantially fully discharged. It has been envisaged that terminating the primary current a short time before or after the charge storage means is substantially fully discharged would also provide the substantial benefits and not have any significant adverse effect to the workings of the system.

In one embodiment, the switching means may be arranged to terminate the discharge of the charge storage means after a preselected period, for example, with the use of a monostable device to activate and deactivate a switch device.

In another embodiment, the system may also comprise a monitoring means arranged to determine when the charge storage means is substantially fully discharged and to deactivate the switching means. The monitoring means can be a voltage or current meter appropriately disposed in the system.

In a further embodiment, the system may further comprise means for modifying the rate of discharge of the charge storage means to initially obtain a first rate of discharge for establishing the spark and then to obtain a reduced rate of discharge for sustaining the spark.

Advantageously, two charge storage means may be coupled to the primary coil and preferably, a charge storage isolation means is also provided in the circuit between the two charge storage means. During the discharge of the first charge storage means, the second charge storage means is arranged to discharge together therewith, for modifying the rate of discharge of the first charge storage means. This second discharge can operate selectively or periodically.

The switching means may operate to discharge each of the two charge storage means. Conveniently, a charging circuit is provided as a source to supply charges to the two charge storage means.

DESCRIPTION OF THE INVENTION

The present invention will now be described with reference to different embodiments thereof, and with reference to the accompanying drawings. It should be clearly understood, however, that the description of the embodiments, and the drawings, are given purely for the purpose of explanation and exemplification only, and are not intended to be limitative of the scope of the present invention in any way.

Figure 1:
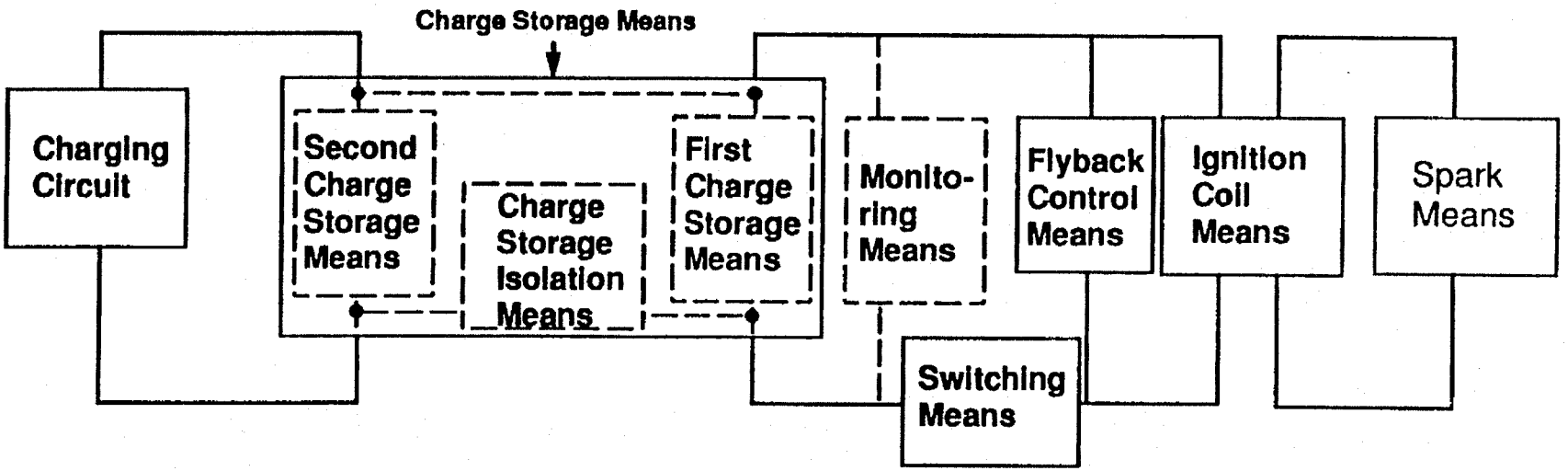
FIG. 1 is a schematic diagram of a capacitative discharge ignition system.
Figure 2:
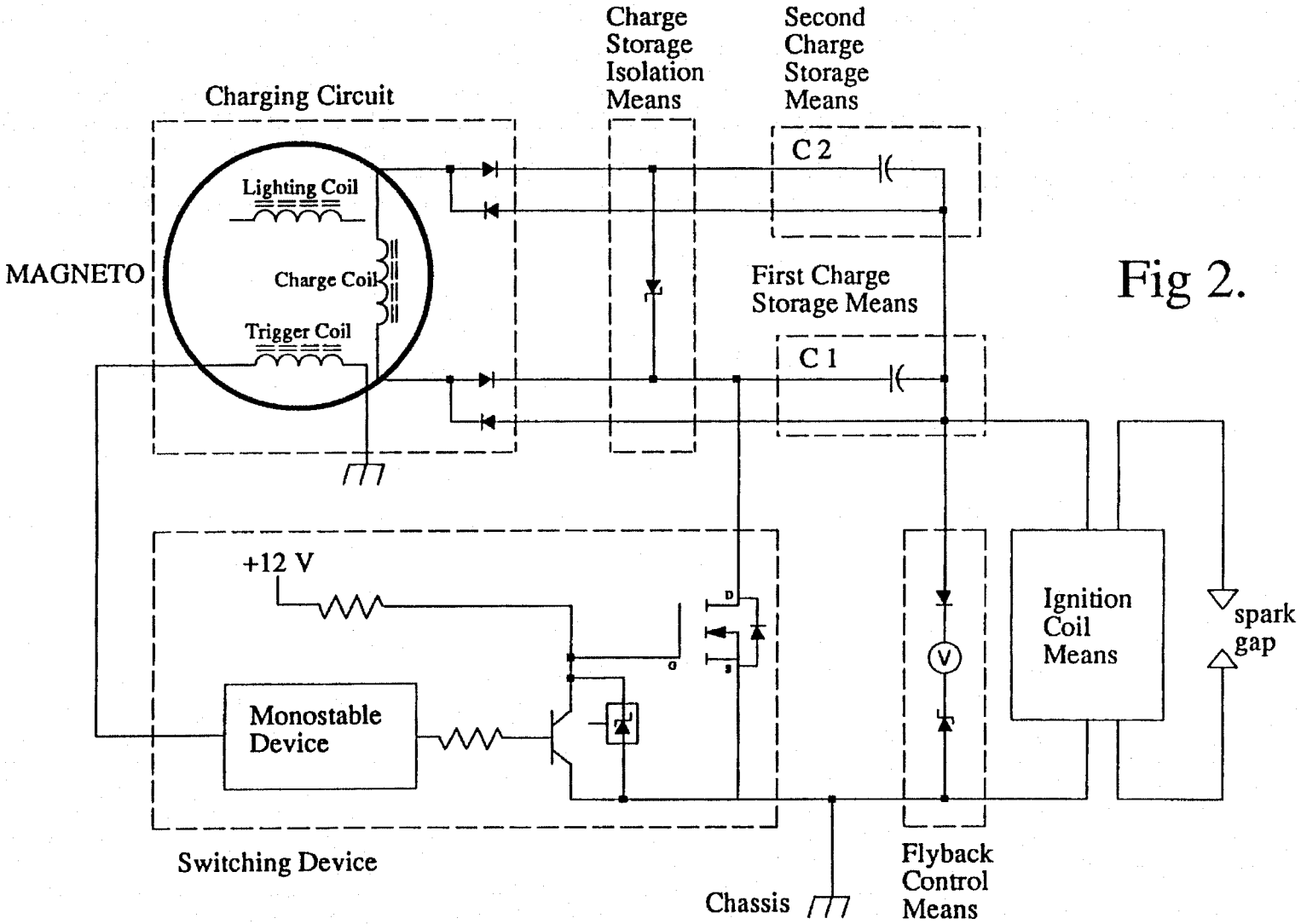
FIG. 2 is a circuit diagram of the capacitative discharge ignition system of FIG. 1.

Referring to FIG. 1, the capacitative discharge ignition system comprises a charge storage means coupled to the primary coil of an ignition coil means. The secondary coil of the ignition coil means is coupled to a spark means, for example, as shown in FIG. 2, a spark plug having a spark gap.

A switching means is disposed in the primary circuit of the ignition system between the charge storage means and the ignition coil means. The switching means is arranged to be selectively or periodically activated and deactivated, that is turned on and off, to discharge the charge storage means.

The turning on of the switching means would provide a primary current through the primary coil of the ignition coil means and thus, enabling the spark means in the secondary circuit to generate a spark.

The turning off of the switching means breaks the primary circuit and terminates the primary current in the primary circuit. However, as energy has been stored in the primary coil during the discharge, this would induce a flyback potential of reverse polarity to the discharge potential across the primary coil and also a spark potential of reverse polarity across the secondary coil. The induced flyback energy would be dissipated in the secondary circuit by regenerating the spark across the spark gap. The effect is to increase the total spark duration, that is the duration of the spark generated by the discharge potential and regenerated by the induced flyback potential.

As shown in the drawings, a flyback control means is also coupled to the primary coil of the ignition coil means as a means of protecting circuit components from large flyback potentials. Further, the charge storage means may, in one embodiment, include a first charge storage means and a second charge storage means arranged in a parallel circuit and separated by a charge storage isolation means. A charging circuit is also coupled to the two charge storage means, which is provided as a source to supply charges thereto. The two charge storage means are isolated by the charge storage isolation means during both charging and discharging operations.

The discharging operation may involve discharging both the first and second charge storage means.

It will be appreciated that the discharge of the first charge storage means initiates the primary current through the primary coil and would enable the spark plug to produce a spark across the spark gap, and that when the second charge storage means is arranged to discharge during the discharge of the first charge storage means, the discharge of the second charge storage means would provide control of the rate of discharge of the first charge storage means. In particular, the primary current is maintained and may be varied to extend the duration of the discharge operation.

It is important that the spark potential of reverse polarity induced across the secondary coil is sufficient to re-ionise the spark gap of the spark plug. In this regard, it is preferable and convenient to turn off the switching means terminating the primary current at about the time when the charge storage means is substantially fully discharged. This allows the primary coil to store more energy discharge from the charge storage means and also reduces the dissipation within the primary circuit of the stored energy of the primary coil. In this way, the flyback energy and potential can be maximised.

The flyback potential required to regenerate the spark is in general lower than the discharge potential required to generate the spark in the first place. This is because the initial high discharge potential has caused ions to be formed at the spark gap and these ions would remain charged for a short time. Thus, only a relatively lower flyback potential would be required to regenerate the spark, just as a relatively lower discharge potential is required to sustain a spark once it has been established.

Accordingly, depending on the value of the discharge energy and potential and the particular circuit, the switching means may be arranged to be turned off before or after the charge storage means is substantially fully discharged, preferably a short time therebefore or a short time thereafter. Any energy trade off would also depend on the nature of the ignition system and the type of combustion engine.

In another embodiment, the ignition system may be provided with a monitoring means arranged to determine when said charge storage means is substantially fully discharged and to deactivate the switching means. As shown in phantom lines in FIG. 1, the monitoring means is a means for monitoring the voltage across the charge storage means. Alternatively, it may be a means for monitoring the primary current or the potential across the primary coil.

In a further embodiment, the monitoring means may be a means to monitor the ionisation at the spark gap for determining the time to turn off the switching means. It is important that there are sufficient ions remaining charged at the spark gap for the flyback potential to regenerate the spark.

Referring to FIG. 2, the first charge storage means is a low-capacitance high-voltage capacitor C1, for example having a rating of 1 μF and 400 V. The second charge storage means is a high-capacitance low-voltage capacitor C2, for example having a rating of 47 μF and 100 V.

The charge storage isolation means is a diode which has its forward bias in the direction of the high-voltage capacitor C1, and preferbly is a zener diode. The diode provides current regulation to the low-voltage capacitor C2 against any discharge of large potential from the high-voltage capacitor C1. In this regard, it will be understood that the low-voltage capacitor C2 will not discharge until the potential of the high-voltage capacitor C1 has through discharge reached or passed the potential of the low-voltage capacitor C2.

The charging circuit is in the form of a magneto of the fixed coil type having an earth isolated charge coil. Energy generated in the charge coil each revolution of the magneto is stored in the respective capacitors via rectifying diode circuits.

The small capacity of C1 results in it being charged to a higher voltage than C2 which has a larger capacity. The zener diode isolation means operates to stop current flowing from the high potential C1 to the low potential C2.

The switching means is a transistorised device coupled to a trigger coil with the magneto of the charging circuit. Every revolution of the magneto, the trigger coil produces an EMF which is used to triger a monostable device of the switching means. The triggering produces a set duration pulse which activates a switch device to turn on the discharge operations of the capacitors and then deactivates the switch device at the end of the set duration pulse. A buffer device is provided between the monostable device and the switch device, which can be a field effect transistor as shown, or a bipolar transistor, gate controlled thyristor or gate turn-off thyristor. The switch device can be turned off as well as being turned on.

The flyback control means is a diode in series with a zener diode. The flyback is the reverse in potential across the primary coil of the ignition coil means during collapse of the coil magnetic field when the capacitors are discharged or the switching means is turned off. Conveniently, a potential monitoring means is disposed between the diode and the zener diode to detect the flyback for indicating when the capacitors are fully discharged.

In practice, to produce spark in the abovedescribed capacitative discharge ignition system, it is proposed during the discharge of the low-capacitance high-voltage capacitor C1, to modify the rate of discharge thereof such to initially obtain a first rate of discharge for establishing the spark and then to obtain a reduced rate of discharge for sustaining the spark.

In one method, it is advantageous to turn on the switching means, thus to discharge the high-voltage capacitor C1, providing an initially large potential namely 400 V, across the primary coil of the ignition coil means, and a relatively fast rate of discharge thereof in the primary circuit for establishing the spark across the spark gap in the secondary circuit.

During the discharge of the high-voltage capacitor C1, once the potential thereof reaches or passes that of the low-voltage capacitor C2, namely 100 V, the zener diode isolation means operates into forward bias to discharge the high-capacitance capacitor C2, also across the primary coil of the ignition coil means.

With the discharging current passing through the primary coil being maintained, the simultaneous discharge of the capacitors C1 and C2 will significantly reduce the rate of discharge of the low-capacitance capacitor C1, and extend the duration of the capacitative discharge of the ignition system and thus, the spark duration.

The initial discharge of the high-voltage capacitor C1 enables sufficient spark voltage to build up in a relatively short period and the subsequent simultaneous discharge together with the high-capacitance capacitor C2 provides further energy to sustain the spark, which may be established either before or after the introduction of the further capacitor C2.

In alternative embodiments, the high-capacitance low-voltage capacitor C2 can have different ratings, say 100 μF and 50 V or 20 μF and 200 V, such that the discharge thereof may occur after a predetermined period after the initiation of discharging the high-voltage capacitor C1. This predetermined period may in practice coincide with the time taken for establishing or producing the spark. Likewise, the low-capacitance high-voltage capacitor C1 can also have different ratings, for similar purposes. Thus, both the predetermined period and spark duration can be efficiently controlled.

Instead of having a single capacitor C2 with a zener diode isolation means as the means for modifying the rate of discharge of the capacitor C1, the arrangement may comprise a number of capacitors having different capacitance and potential ratings with respective diodes disposed therebetween. The respective capacitors would then discharge when the respective potentials are or have been reached. In this regard, the arrangement thereof must ensure that there remains a sufficient change of magnetic flux through the primary coil for inducing the required EMF. It will be seen that such arrangement would enhance the control of the rate of discharge of the capacitor C1.

Instead of having a high-capacitance low-voltage capacitor C2, the second charge storage means can be a battery pack. In which case, the switching means can be further arranged to turn on and off selectively or periodically the battery to connect it to the primary coil, after the high-voltage capacitor C1 has reached or discharged to below the potential of the battery.

Figure 3:
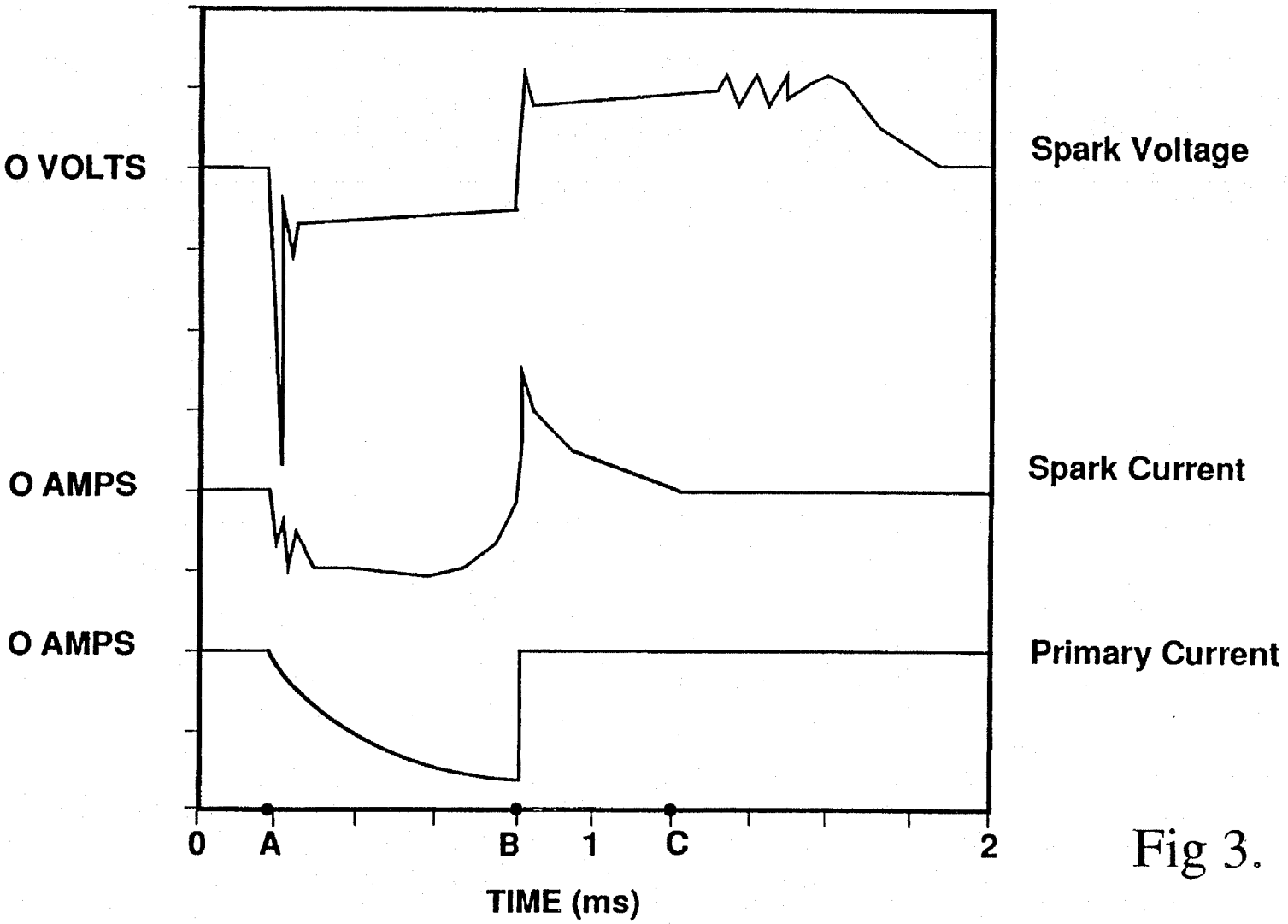
FIG. 3 shows the primary current, the spark current and the spark voltage of the capacitative discharge ignition system of FIG. 1.

Referring to FIG. 3, the discharge of the first charge storage means C1 occurs at time A. The primary current rises to a maximum value until it is terminated at time B. The spark voltage builds up rapidly in a relatively short period, that is to a first peak, to establish the spark, and the spark current also rises to a peak.

The discharge of the second charge storage means C2 occurs at about the time, or a short time after, the spark is established but before the spark voltage and current begin to deteriorate. In this regard, the primary current continues to rise. Both the spark voltage and spark current are maintained, that is the spark as produced is being sustained, until both the first and second charge storage means are fully discharged at time B. This modification of the rate of discharge of the charge storage means extends the spark duration of the ignition system, for example, typically from about 0.4 ms to about 0.6 ms.

When the charge storage means is fully discharged, the primary current would begin to deteriorate. The spark voltage would disappear across the secondary coil, causing the spark to disappear and the spark current to reduce to zero. The energy stored in the primary coil would drive the deteriorating primary current and would in time be dissipated within the primary circuit. Thus, it is possible to monitor the ignition system to determine the time B.

It is also proposed to terminate the primary current in the primary circuit, say at about the time B. As a result, a flyback potential having reverse polarity to the discharge potential appears across the primary coil and a further spark potential also having reverse polarity appears across the secondary coil. This induced flyback spark potential is lower than the capacitative discharge spark potential, but is sufficient to re-ionise the spark gap, regenerating or restriking the spark and increasing the total spark duration.

As shown in FIG. 3, after time B, the primary current disappears and a spark current in the opposite direction is induced and deteriorates over time, for example, over 0.4 ms. The total spark duration of the ignition system as shown, that is the period between the times A and C, is around 1 ms.

Advantageously, the method of flyback control also provides that a minimum current flows in the primary coil during flyback operation, which maximises the energy transferred into the spark gap to also maximise the spark duration.

We claim:

1. A method for producing spark in a capacitive discharge ignition system of an internal combustion engine, comprising the steps of:

isolating a first charge storage device from a second charge storage device by a charge storage isolation device;

charging said first charge storage device with a charging circuit;

charging said second charge storage device with said charging circuit;

operating a switching means to discharge said first charge storage device to cause an ignition coil spark means to generate a first spark;

upon a potential of said charge storage means falling below a potential of said second charge storage means, discharging said second charge storage device for prolonging the first spark;

operating said switching means at approximately a time said first and second charge storage devices are substantially fully discharged for inducing a flyback potential in a primary coil of said ignition coil spark means operatively connected to said first charge storage device and said second charge storage device;

thereby inducing a current to flow at said ignition coil spark means thereby generating a second spark.

2. The method as claimed in claim 1 wherein said switching means is operated before said first and second charge storage devices are substantially fully discharged to induce said flyback potential.

3. The method as claimed in claim 1 or 2 wherein at least one said charge storage device is isolated from said ignition coil means after a predetermined period.

4. The method as claimed in claim 1 further comprising monitoring a degree of discharge of at least one said charge storage device during discharge thereof and when a predetermined level of discharge from at least one said charge storage device from said ignition coil means is monitored, isolating at least on said charge storage device from said ignition coil means to enable a flyback potential stored in the ignition coil means to induce a further current at said ignition coil spark means thereby generating said second spark.

5. The method as claimed in claim 4 wherein said predetermined level of discharge is substantially full discharge.

6. The method as claimed in claim 1 further comprising modifying, during discharge of at least one said charge storage device, a rate of discharge of said charge storage device to initially obtain a first rate of discharge for establishing said spark and then to obtain a reduced rate, less than said first rate, of discharge for sustaining said first spark.

7. The method as claimed in claim 6 wherein said first and second charge storage devices are capacitors having different potential ratings with respective charge storage isolation means disposed therebetween, and wherein the method further comprises: discharging said respective capacitors when the respective potentials have been reached.

8. A method as claimed in claim 7 further comprising:

discharging a first low-capacitance high-voltage capacitor to establish said first spark, and discharging a second high-capacitance low-voltage capacitor, isolated by a diode to sustain said spark as produced.

9. A capacitive discharge ignition system for use in an internal combustion engine, comprising:

a charging circuit;

a switching means;

a first charge storage device and a second charge storage device operatively connected to said charging circuit;

a charge storage isolation means, operatively disposed between said first charge storage device and said second charge storage device;

an ignition means operationally connected to a spark means, operationally connected to said first and second charge storage devices through a sparking circuit for creating a spark;

a flyback control means operationally connected to said first and second charge storage devices causing a further current flow in said sparking circuit to generate a second spark.

10. The system as claimed in claim 9 further comprising a monitoring means for monitoring a degree of discharge of at least one said charge storage device.

11. The system as claimed in claim 9 wherein said switching means comprises a monostable device for activating a switch device after a predetermined period.

12. The system as claimed in claim 10 wherein said monitoring means is a means for monitoring a potential across said ignition coil.

13. The system as claimed in claim 10 wherein said monitoring means is a means for monitoring a voltage across at least one of said charge storage devices.

14. The system as claimed in claim 10 wherein said monitoring means is a means for monitoring a current in said charging circuit.

15. The system as claimed in claim 9 wherein a flyback control means is coupled to said ignition coil means.

16. The system as claimed in claim 9 further comprising means for modifying the rate of discharge of at least one of said charge storage device for initially obtaining a first rate of discharge for establishing said spark and then for obtaining a reduced rate, less than said first rate, of discharge for sustaining said spark.

17. The system as claimed in claim 9 wherein said first and second charge storage devices are capacitors having different potential ratings with respective charge storage isolation means disposed therebetween.

18. The system as claimed in claim 9 wherein one charge storage device is a low-capacitance high-voltage capacitor and other charge storage device is a high-capacitance low-voltage capacitor.

19. The system as claimed in claim 9 wherein a diode is arranged to isolate said first and second charge storage devices.

* * * * *

UNITED STATES PATENT AND TRADEMARK OFFICE

CERTIFICATE OF CORRECTION

PATENT NO. : 5,531,206

DATED : July 2, 1996

INVENTOR(S) : Kitson et al

It is certified that error appears in the above-indentified patent and that said Letters Patent is hereby corrected as shown below:

On the title page: Item [63], line 3, please delete "Nov. 15, 1990" insert therefor --Nov. 15, 1991 --.

Signed and Sealed this

Seventh Day of January, 1997

Bruce Lehman

*Attest:*

BRUCE LEHMAN

*Attesting Officer*

*Commissioner of Patents and Trademarks*